US006763806B2

(12) United States Patent
Hosoya

(10) Patent No.: US 6,763,806 B2
(45) Date of Patent: Jul. 20, 2004

(54) COMBUSTION CONTROL APPARATUS AND COMBUSTION CONTROL METHOD OF INTERNAL COMBUSTION ENGINE

(75) Inventor: Hajime Hosoya, Atsugi (JP)

(73) Assignee: Unisia Jecs Corporation, Kanagawa-Ken (JP)

( * ) Notice: Subject to any disclaimer, the term of this patent is extended or adjusted under 35 U.S.C. 154(b) by 66 days.

(21) Appl. No.: 10/117,226

(22) Filed: Apr. 8, 2002

(65) Prior Publication Data

US 2002/0144672 A1 Oct. 10, 2002

(30) Foreign Application Priority Data

Apr. 10, 2001 (JP) ..... 2001-111331

(51) Int. Cl.[7] ..... F02P 5/00
(52) U.S. Cl. ..... 123/406.27; 123/637; 123/638
(58) Field of Search ..... 123/406.27, 406.41, 123/406.42, 406.37, 637, 638

(56) References Cited

U.S. PATENT DOCUMENTS 4,112,890 A * 9/1978 Manger et al. ..... 123/406.59
4,846,128 A * 7/1989 Yagi et al. ..... 123/406.27
5,038,744 A * 8/1991 Martin et al. ..... 123/625
5,333,593 A * 8/1994 Morganti et al. ..... 123/637

FOREIGN PATENT DOCUMENTS

JP 58-195068 11/1983
JP 7-180645 7/1995
JP 9-49452 2/1997

* cited by examiner

*Primary Examiner*—Bibhu Mohanty
(74) *Attorney, Agent, or Firm*—Sughrue Mion, PLLC

(57) ABSTRACT

A combustion state during the initial stage after ignition is detected, and based on the detected combustion state, it is judged whether or not incomplete combustion has occurred, and when it is judged that incomplete combustion has occurred, an ignition signal is output so as to perform the re-ignition immediately.

14 Claims, 7 Drawing Sheets

COMBUSTION CONTROL APPARATUS AND COMBUSTION CONTROL METHOD OF INTERNAL COMBUSTION ENGINE

FIELD OF THE INVENTION

The present invention relates to a combustion control technique of an internal combustion engine, and particularly, to an ignition control technique for suppressing a variation of combustion pressure for each cycle.

RELATED ART

Heretofore, a lean combustion engine has been known in which a mixture having a much leaner air-fuel ratio than a theoretical air-fuel ratio is combusted (refer to Japanese Unexamined Patent Publication No. 9-049452).

When combustion is performed in the vicinity of a lean limit, the combustion becomes unstable, randomly causing cycles where a combustion pressure is high and cycles where the combustion pressure is low.

Therefore, conventionally, there has been caused a problem in that in order to suppress the fluctuation of combustion pressure for each cycle by stabilizing the combustion, a lean limit air-fuel ratio is narrowed toward a rich side.

As disclosed in Japanese Unexamined Patent Publication No. 58-195068, a method has been proposed where the deterioration of combustion is judged so as to re-ignite the engine. However, according to this method, since the deterioration of combustion is judged around the maximal point of combustion pressure, only a misfire is prevented, and the fluctuation of combustion pressure cannot be prevented.

SUMMARY OF THE INVENTION

The present invention is aimed at solving the above-mentioned problem, and an object thereof is to enable to reduce the cycle fluctuation of combustion pressure during the combustion performed in the vicinity of a lean limit by an appropriate ignition control, to thereby expand a lean limit air-fuel ratio toward a leaner side.

In order to achieve the above object, the present invention is constituted such that a combustion state is judged soon after the starting of combustion in an initial stage after the ignition, and when an occurrence of incomplete combustion is judged, the re-ignition is performed immediately.

According to this constitution, the combustion property during that combustion stroke is improved at once, and the combustion pressure is sufficiently increased, so that the cycle fluctuation of the combustion pressure during combustion in the vicinity of the lean limit can be reduced to expand the lean limit air-fuel ratio toward the leaner side.

The other objects and features of the present invention will become understood from the following description with reference to the accompanying drawings.

DETAILED DESCRIPTION OF THE PREFERRED EMBODIMENT

Preferred embodiment of the present invention will now be described.

Figure 1:
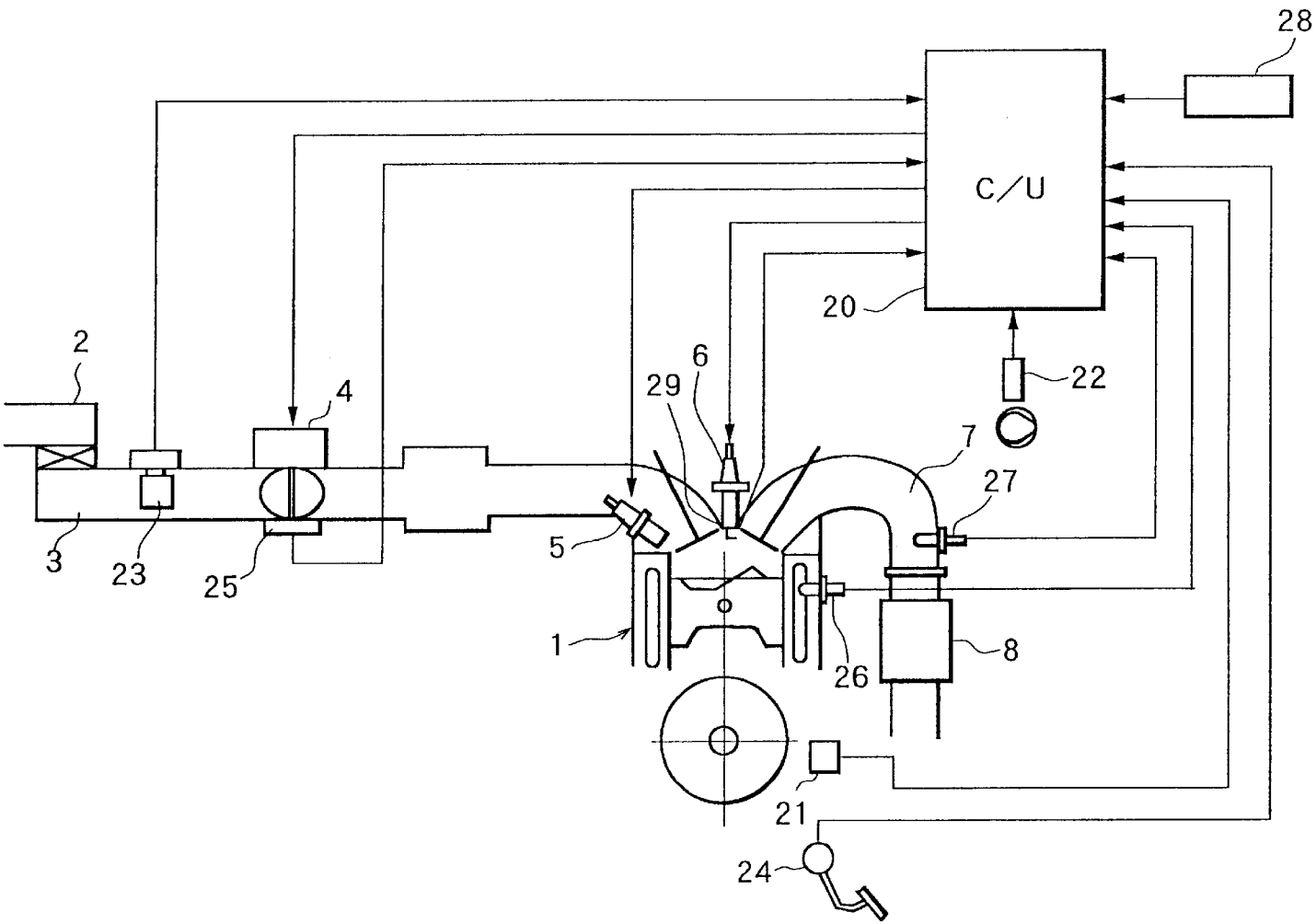
FIG. 1 shows a system structure of an internal combustion engine in an embodiment.

FIG. 1 shows a system structure of an internal combustion engine in a preferred embodiment, wherein air is sucked into a combustion chamber equipped to each cylinder of an internal combustion engine 1 mounted on a vehicle through an air cleaner 2, an intake passage 3, and an electronically controlled throttle valve 4 driven to open and close by a motor.

An electromagnetic fuel injection valve 5 is disposed to directly inject fuel (gasoline) into the combustion chamber of each cylinder, and an air-fuel mixture is formed inside the combustion chamber by the fuel injected through fuel injection valve 5 and the sucked air.

Fuel injection valve 5 is opened with the power supply to a solenoid based on an injection pulse signal output from a control unit 20, to inject fuel controlled to a predetermined pressure.

In a case of an intake stroke injection, the injected fuel is diffused within the combustion chamber to form a homogeneous mixture, and in a case of a compression stroke injection, the injected fuel forms a stratified mixture concentrated around an ignition plug 6.

The mixture created inside the combustion chamber is ignited to be combusted by ignition plug 6.

However, internal combustion engine 1 is not limited to the above-mentioned direct injection gasoline engine, but it can also be an engine constituted to inject fuel to an intake port.

The exhaust gas from engine 1 is discharged through an exhaust passage 7, and a catalyst 8 for purifying the exhaust gas is disposed to exhaust passage 7.

Control unit 20 incorporates therein a microcomputer comprising a CPU, a ROM, a RAM, an A/D converter and an input/output interface. Control unit 20 receives input signals from various sensors and performs arithmetic processing based on those input signals to control the operations of fuel injection valve 5, ignition plug 6, etc.

The various sensors include a crank angle sensor 21 that detects a crank angle of engine 1 and a cam sensor 22 that takes out a cylinder discrimination signal from a camshaft, and a rotation speed Ne of engine is computed based on the signal from crank angle sensor 21.

Other than the above sensors, the various sensors further include an air flow meter 23 that detects an intake air flow amount Q (mass flow amount) on the upstream side of throttle valve 4 in intake passage 3, an accelerator sensor 24 that detects a depression amount of an accelerator pedal (accelerator opening) APS, a throttle sensor 25 that detects an opening TVO of throttle valve 4, a water temperature sensor 26 that detects the cooling water temperature Tw of engine 1, an air-fuel ratio sensor 27 that detects an air-fuel ratio of combustion mixture according to the oxygen concentration within the exhaust gas, a speed sensor 28 that detects a vehicle speed VSP, and an inner cylinder pressure sensor 29 comprising piezoelectric elements mounted to each ignition plug 6 of each cylinder as a washer. Moreover, one ignition plug 6 is equipped per one cylinder, but two ignition circuits (not shown) that ignites ignition plug 6 are equipped per one cylinder so as to perform the re-ignition when an incomplete combustion state is judged. Note, the constitution may be such that a plurality of ignition plugs are equipped per one cylinder, and one ignition circuit is equipped per each ignition plug, to perform the re-ignition.

Control unit 20 sets a target air-fuel ratio based on an engine load, the engine rotation speed, the cooling water temperature, an elapsed time after start etc., and selects either the homogeneous combustion based on intake stroke injection or the stratified combustion based on intake stroke injection.

Then, control unit 20 while computing a fuel injection quantity Tp corresponding to the target air-fuel ratio, performs an ignition control of ignition plug 6 so as to suppress a variation of combustion pressure in each cycle when an air-fuel ratio leaner than the theoretical air-fuel ratio is set as the target air-fuel ratio.

Here, the ignition control for suppressing the variation of combustion pressure in each cycle will now be described in detail with reference to the flowcharts of FIG. 2 and following.

Figure 2:
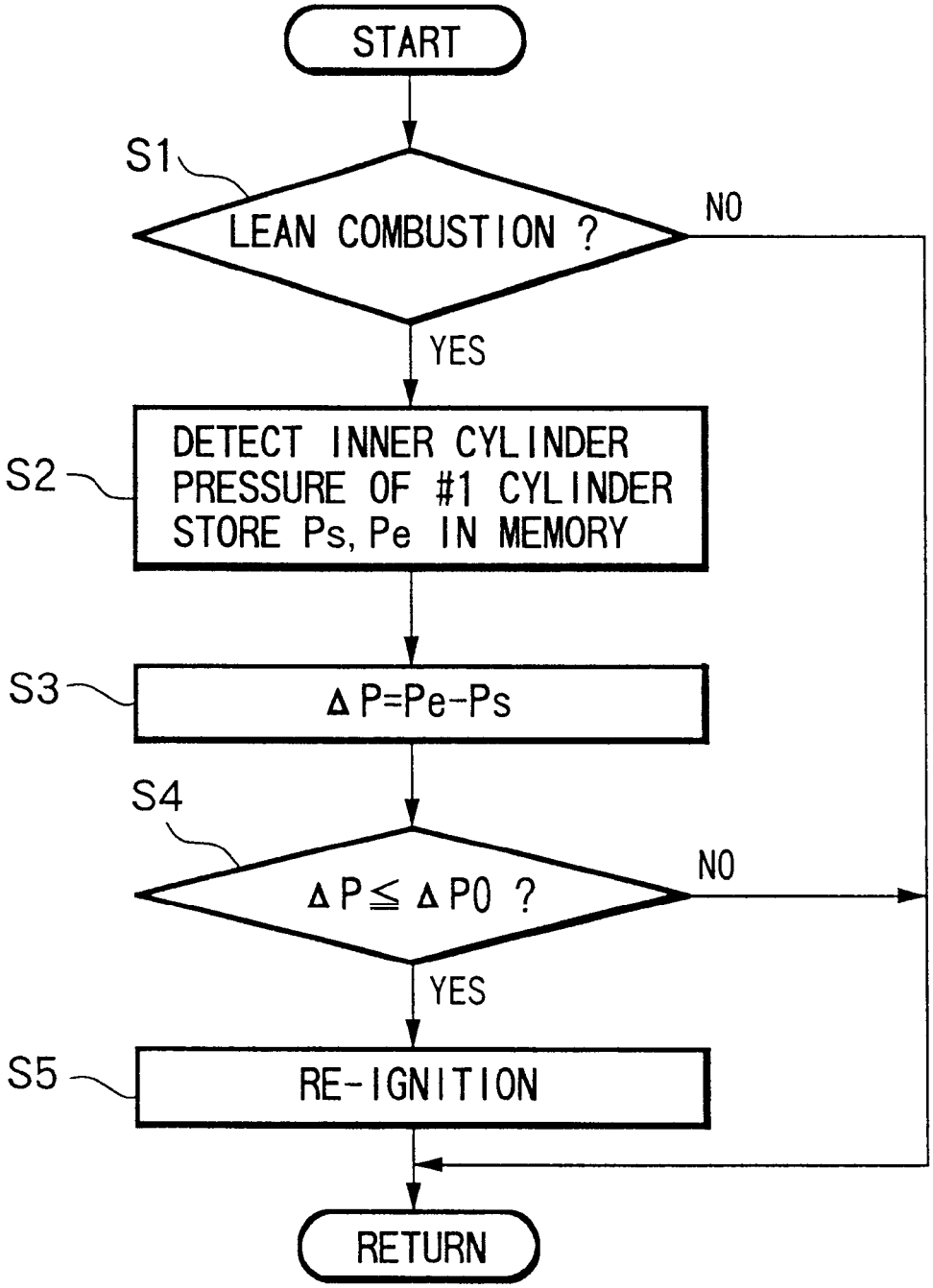
FIG. 2 is a flowchart showing a first embodiment of ignition control.

The flowchart of FIG. 2 showing an ignition control according to a first embodiment indicates a process related to #1 cylinder, but in parallel with this process, a similar process is performed in the other cylinders (same for second and third embodiments).

Figure 3:
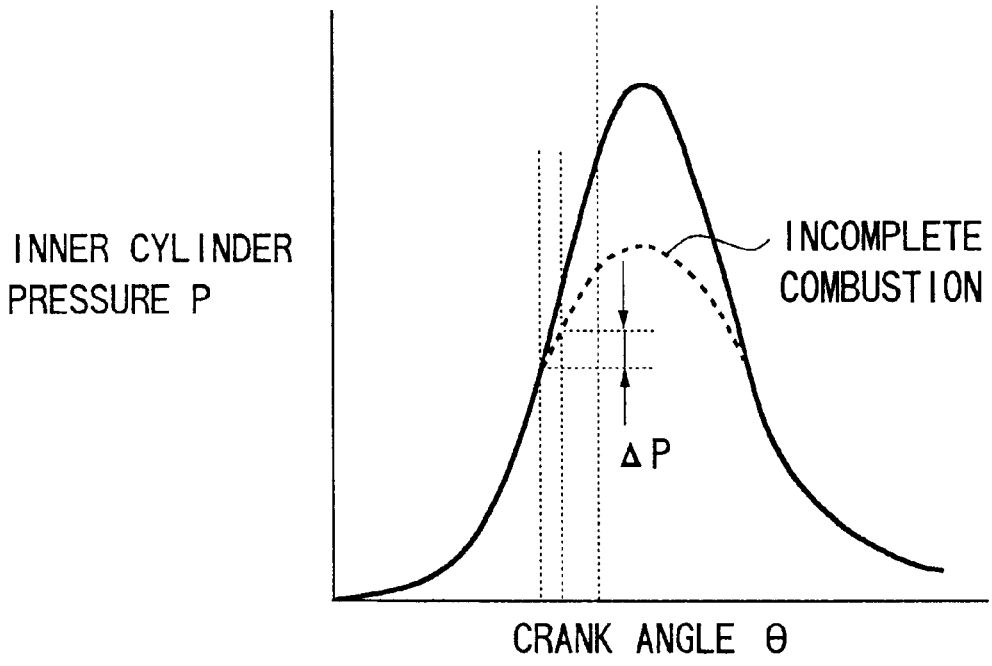
FIG. 3 is a diagram showing the operation of the first embodiment.

The ignition control according to the first embodiment is described in accordance with FIG. 2 while referring to FIG. 3. In step S1, it is judged whether or not the combustion is in a lean combustion state.

If the combustion is in the lean combustion state, the procedure advances to step S2, where an inner cylinder pressure of #1 cylinder is detected based on the detection signal from inner-cylinder pressure sensor 29 equipped to #1 cylinder, and an inner cylinder pressure Ps at the starting time and an inner cylinder pressure Pe at the ending time of a predetermined crank angle period set corresponding to an initial stage after the ignition are stored in a memory. Since the combustion is limited to a lean combustion operation, the first basic ignition timing is substantially constant, so the predetermined crank angle period may be set to a fixed period. However, in order to accelerate the combustion pressure rise by the re-ignition, the ending time of the predetermined crank angle period in which the judgment of the combustion state is completed is set to be before the compression top dead center.

Then, in step S3, a change amount of inner cylinder pressure during the predetermined crank angle period, that is, the change rate ΔP of the inner cylinder pressure, is computed by the following equation.

$$\Delta P = Pe - Ps$$

In step S4, the change rate ΔP of the inner cylinder pressure is compared with a predetermined judgment level ΔP0.

Then, if it is judged that the change rate ΔP is equal to or less than the predetermined judgment level ΔP0, it is judged that incomplete combustion has occurred, and the procedure advances to step S5 to perform the re-ignition immediately.

If it is judged that the change rate ΔP exceeds the judgment level ΔP0, then the combustion state is judged to be normal, and the present flow is ended without performing the re-ignition.

Thus, by a simple operation computing a difference between inner cylinder pressures, it is possible to accurately judge at the initial stage after starting combustion whether or not incomplete combustion has occurred, and to perform the re-ignition to increase the combustion pressure promptly. Thus, it is possible to reduce the cycle fluctuation of the combustion pressure during the combustion in the vicinity of a lean limit. Thereby, a lean limit air-fuel ratio can be extended toward a leaner side.

Figure 4:
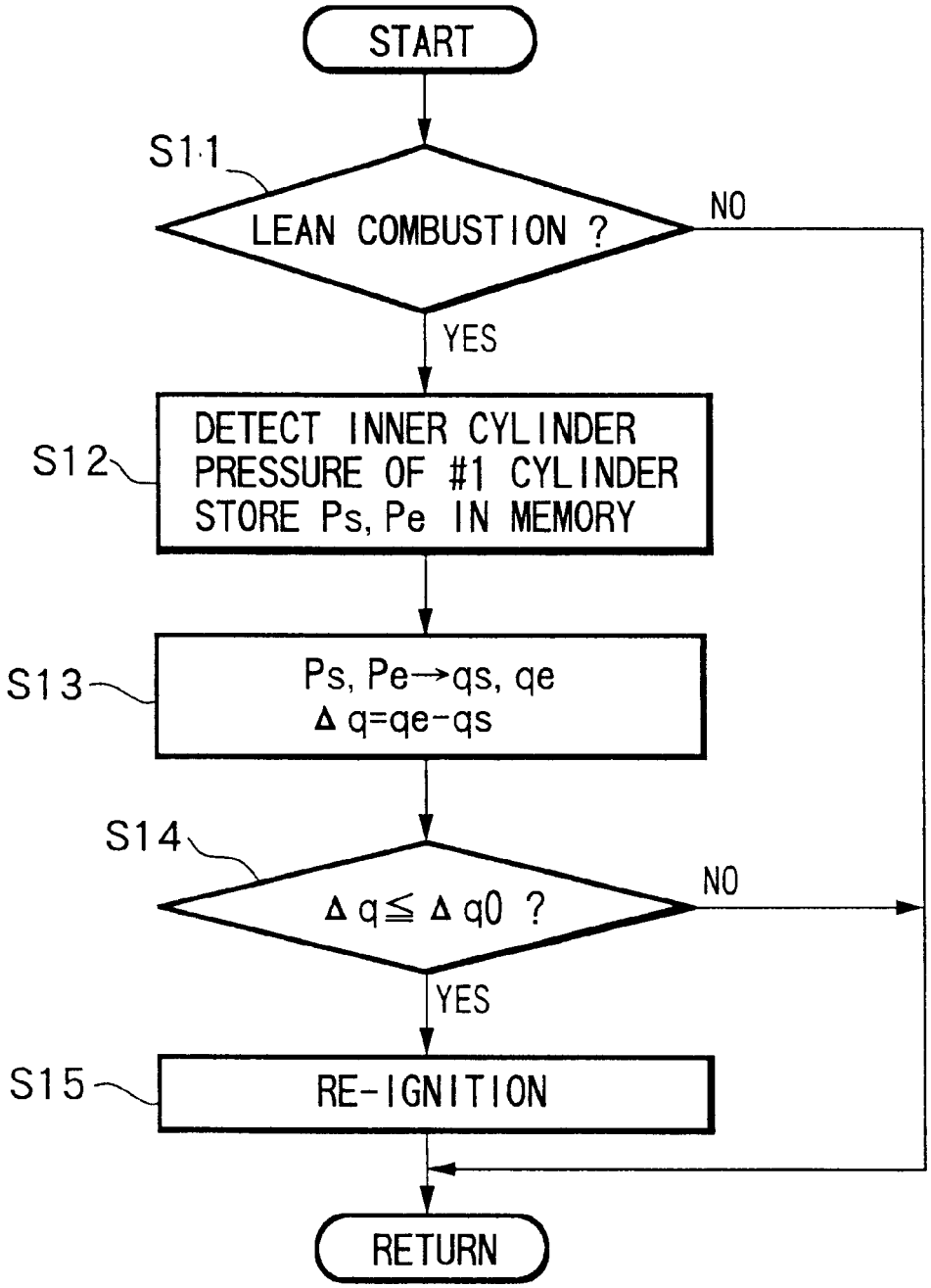
FIG. 4 is a flowchart showing a second embodiment of ignition control.
Figure 5:
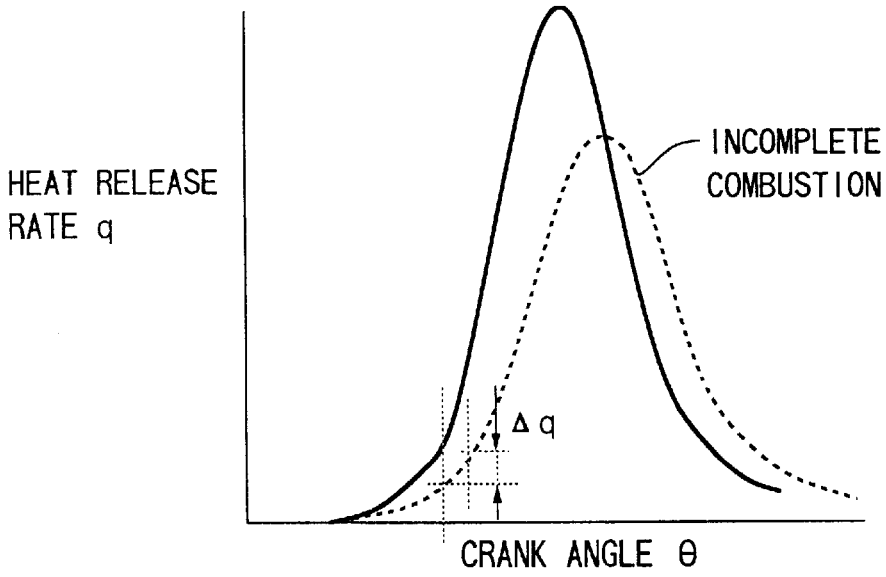
FIG. 5 is a diagram showing the operation of the second embodiment.

Next, an ignition control according to a second embodiment will be described in accordance with the flowchart of FIG. 4 while referring to FIG. 5.

Steps S11 and S12 are the same as steps S1 and S2, respectively.

In step S13, a change amount or change rate of the heat release rate during the predetermined crank period is computed. The heat release rate can be computed by a known method based on the detected value of inner cylinder pressure and the inner cylinder pressure during motoring (refer to Japanese Unexamined Patent Publication No. 7-180645). Based on the inner cylinder pressures Ps and Pe at the starting time and ending time of the predetermined crank period and inner cylinder pressures Ps0 and Pe0 during motoring (known values obtained in advance by measurement), the rate of heat release "qs" at the starting time of the predetermined crank angle period and the rate of heat release "qe" at the ending time thereof are computed using the above-mentioned known method, and based on the computed values, the change rate Δq of the heat release rate q is computed using the following equation.

$$\Delta q = qe - qs$$

In step S14, the change rate Δq of the heat release rate is compared with a predetermined judgment level Δq0.

If it is judged that the change rate Δq is equal or less than the judgment level Δq0, it is judged that incomplete combustion has occurred, and the procedure advances to step S15 where the re-ignition is performed immediately.

If it is judged that the change rate Δq exceeds the judgment level Δq0, the combustion state is judged to be normal, and the present flow is ended without performing the re-ignition.

According to this procedure, the rate of heat release caused by combustion is computed based on the pressure rise rate obtained by subtracting the inner cylinder pressure rise caused by compression, and the occurrence of incomplete combustion is judged based on the change rate of the heat release rate, thus improving the judgment accuracy.

Figure 6:
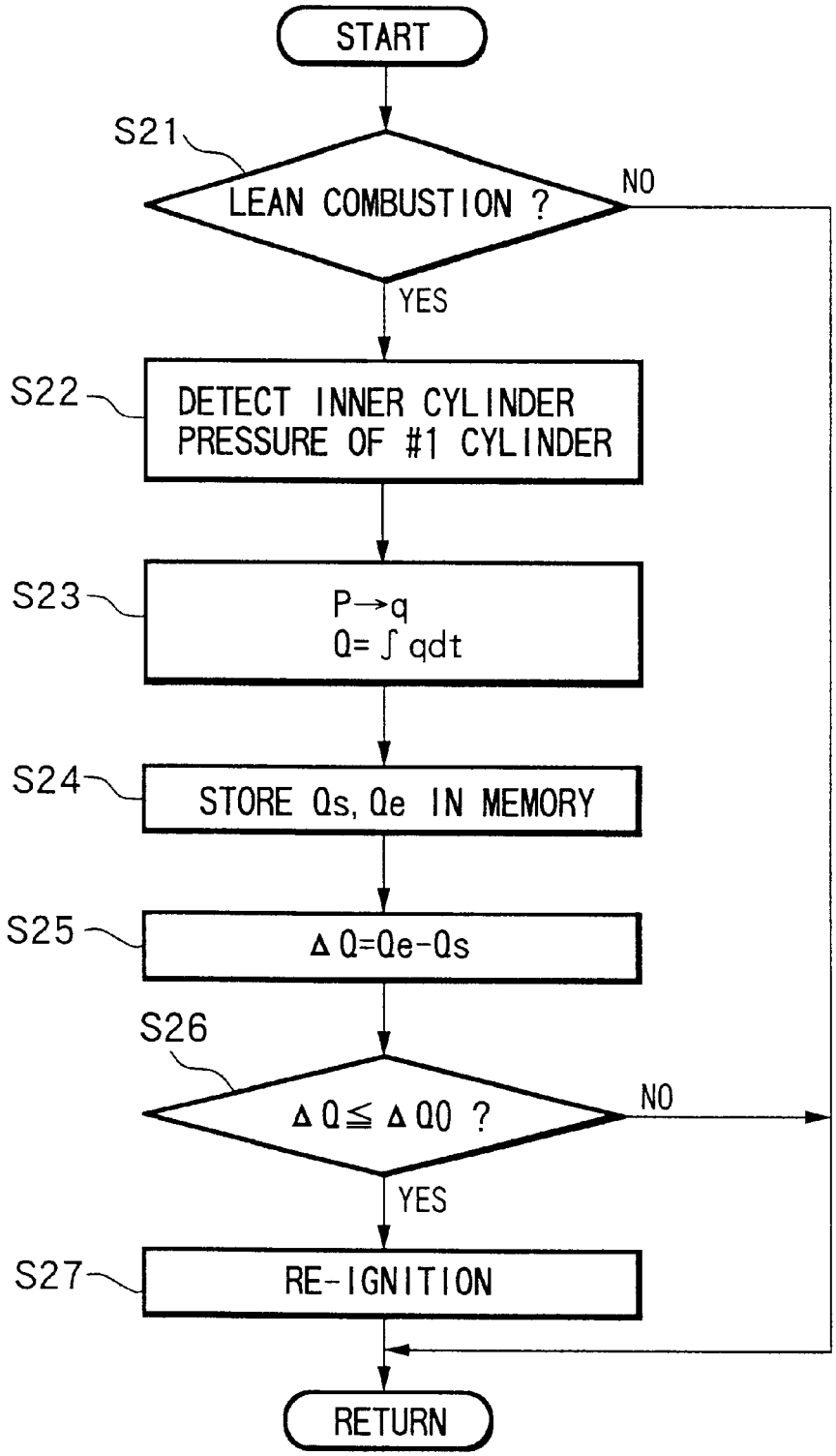
FIG. 6 is a flowchart showing a third embodiment of ignition control.
Figure 7:
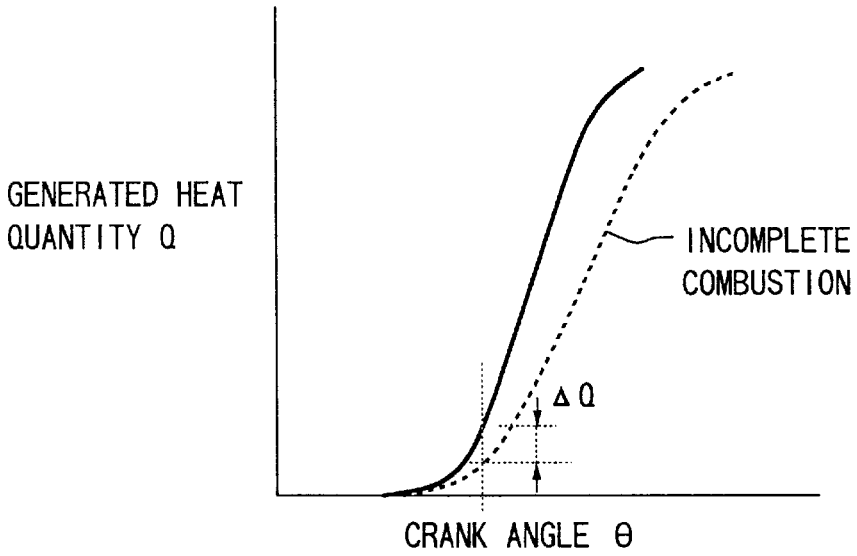
FIG. 7 is a diagram showing the operation of the third embodiment.

Next, an ignition control according to a third embodiment of the present invention is described in accordance with the flowchart of FIG. 6 while referring to FIG. 7.

In step S21, it is judged whether or not the combustion is in the lean combustion state, and if the combustion is in the lean combustion state, the procedure advances to step S22 where an inner cylinder pressure P of #1 cylinder is detected.

In step S23, based on the inner cylinder pressure P, the heat release rate q after ignition is computed and integrated by a known method. A generated heat quantity Q ($=\int q dt$) is computed by the integration of the heat release rate q.

In step S24, the generated heat quantity Qs at the starting time of the predetermined crank angle period and the generated heat quantity Qe at the ending time thereof are computed to be stored in the memory.

In step S25, a change amount, that is, the change rate, of the generated heat quantity Qe during the predetermined crank period is computed as follows.

$$\Delta Q = Qe - Qs$$

In step S26, the change rate ΔQ of the generated heat quantity is compared with a predetermined judgment level ΔQ0.

If it is judged that the change rate ΔQ of the generated heat quantity is equal to or less than the judgment level ΔQ0, it is judged that incomplete combustion has occurred, and the procedure advances to step S27 where the re-ignition is performed immediately.

If it is judged that the change rate ΔQ exceeds the judgment level ΔQ0, the combustion state is judged to be normal, and the present flow is ended without performing the re-ignition.

Thus, the judgment accuracy is further improved since the occurrence of incomplete combustion is judged based on the change rate of the generated heat quantity.

According to the above embodiments, the change rate is computed based on the change amounts of various conditions denoting the combustion state during the predetermined crank angle period, but the change rate can also be computed based on the change amount in a predetermined time. However, it is desirable to set this predetermined time so that the judgment process is completed and the re-ignition is performed, before the compression top dead center even during high rotation.

The entire contents of basic Japanese Patent Application No. 2001-111331 filed April 10, a priority of which is claimed, are herein incorporated by reference.

What is claimed is:

1. A combustion control apparatus of an internal combustion engine equipped with an ignition plug, comprising:

a detecting section that detects a combustion state by measuring an engine parameter a plurality of times during an initial stage after ignition; and a controlling section that judges whether or not incomplete combustion has occurred based on the combustion state detected by said detecting section, and outputs an ignition signal so as to perform the re-ignition immediately, when it is judged that incomplete combustion has occurred.

2. A combustion control apparatus of an internal combustion engine according to claim 1, wherein said controlling section completes the judgment on whether or not incomplete combustion has occurred at least before the compression top dead center.

3. A combustion control apparatus of an internal combustion engine according to claim 1, wherein said controlling section computes the change rate of an inner cylinder pressure in each cylinder as a state quantity for judging whether or not incomplete combustion has occurred, and when said change rate of inner cylinder pressure is less than a judgment level, judges that incomplete combustion has occurred.

4. A combustion control apparatus of an internal combustion engine according to claim 1, wherein said controlling section outputs said ignition signal for re-ignition to a single ignition plug, to perform the re-ignition through said single ignition plug.

5. A combustion control apparatus of an internal combustion engine according to claim 1, wherein said controlling section outputs said ignition signal for re-ignition to a plurality of ignition plugs, to perform the re-ignition through said plurality of ignition plugs.

6. A combustion control apparatus of an internal combustion engine equipped with an ignition plug, comprising:

combustion state detection means for detecting a combustion state by measuring an engine parameter a plurality of times during an initial stage after ignition;

incomplete combustion judgment means for judging whether or not incomplete combustion has occurred based on the combustion state detected by said detection means; and re-ignition signal output means for outputting an ignition signal so as to perform the re-ignition immediately, when it is judged by said incomplete combustion judgment means that incomplete combustion has occurred.

7. A combustion control method of an internal combustion engine equipped with an ignition plug, wherein a combustion state during an initial stage after ignition is detected by measuring an engine parameter a plurality of times during said initial stage after ignition, it is judged whether or not incomplete combustion has occurred based on said detected combustion state, and an ignition signal is output so as to perform the re-ignition immediately, when it is judged that incomplete combustion has occurred.

8. A combustion control method of an internal combustion engine according to claim 7, wherein the judgment on whether or not incomplete combustion has occurred is completed at least before the compression top dead center.

9. A combustion control method of an internal combustion engine according to claim 7, wherein the change rate of an inner cylinder pressure in each cylinder is computed as a state quantity for judging whether or not incomplete combustion has occurred, and when said change rate of inner cylinder pressure is less than a judgment level, it is judged that incomplete combustion has occurred.

10. A combustion control method of an internal combustion engine according to claim 7, wherein said ignition signal for re-ignition is output to a single ignition plug, to perform the re-ignition through said single ignition plug.

11. A combustion control method of an internal combustion engine according to claim 7, wherein said ignition signal for re-ignition is output to a plurality of ignition plugs, to perform the re-ignition through said plurality of ignition plugs.

12. The combustion control apparatus of claim 1, wherein the controlling section judges whether or not incomplete combustion has occurred based upon a comparison between two or more measurements taken during the initial stage after ignition.

13. The combustion control apparatus of claim 6, wherein the incomplete combustion judgment means judges whether or not incomplete combustion has occurred based upon a comparison between two or more measurements taken during the initial stage after ignition.

14. The combustion control method of claim 7, wherein it is judged whether or not incomplete combustion has occurred based upon a comparison between two or more measurements taken during the initial stage after ignition.

* * * * *